US006612054B2

(12) United States Patent
Yang

(10) Patent No.: US 6,612,054 B2
(45) Date of Patent: Sep. 2, 2003

(54) ILLUMINATION CASE

(76) Inventor: Fanmo Yang, Room D, E & F, 11th Floor, East Tower Tianxing Building, No. 21, Zhongshan 1 Road, Guangzhou (CN), 90046

( * ) Notice: Subject to any disclaimer, the term of this patent is extended or adjusted under 35 U.S.C. 154(b) by 80 days.

(21) Appl. No.: 10/001,480

(22) Filed: Nov. 1, 2001

(65) Prior Publication Data

US 2002/0095834 A1 Jul. 25, 2002

(51) Int. Cl.[7] ..... G09F 19/02
(52) U.S. Cl. ..... 40/436; 40/470
(58) Field of Search ..... 40/436, 437, 470

(56) References Cited

U.S. PATENT DOCUMENTS 1,964,328 A * 6/1934 Monteith ..... 40/436
4,118,879 A * 10/1978 Simon ..... 40/436
6,226,906 B1 * 5/2001 Bar-Yona ..... 40/437

* cited by examiner

*Primary Examiner*—Cassandra H. Davis
(74) *Attorney, Agent, or Firm*—Intellectual Property Law Group LLP; Otto O. Lee; Juneko Jackson

(57) ABSTRACT

An illumination case used for decoration or advertisement. It includes a case-body, a front cover, an inner frame, a light source, a transparent back plate, an illumination filmstrip, a grating plate, and two step motors with a transmission that drives the grating plate to move. The transparent back plate is fixed onto the inner frame. The illumination filmstrip overlays the transparent back plate and is fixed against it. The two step motors mentioned above are installed on the inner frame behind the upper part or lower part of the transparent back plate, one on the left side, and the other on the right side. The above-mentioned grating plate is fitted with a hanging bar on both the upper side and bottom side respectively, which makes the grating plate spread out neatly. One hanging bar is linked with the transmission of the two above-mentioned step motors through a set of corresponding levers installed on the inner frame. Through this set of levers, the other hanging bar connects with a set of stretch springs that is fitted onto the inner frame behind the transparent back plate.

2 Claims, 2 Drawing Sheets

ILLUMINATION CASE

BACKGROUND

This invention relates to an illumination case used for decoration or advertisement. This invention is an improvement of China Patent ZL00227988. 6, "Novel Lamp Case".

The illumination case design of the "Novel Lamp Case" is based on the method that uses the relative movement of a grating plate to an illumination filmstrip to cause the appearance that pictures on the illumination case are changing or moving. The included grating plate is pressed close to the illumination filmstrip. It is fitted with a set of stretch springs at both the upper side and bottom side, which link to the inner frame to make it spread. Step motors drive the grating plate to move up and down with the transmission located at its upper or lower side, one for the left side, and another for the right side.

The above-mentioned "Novel Lamp Case" has a novel and simple structure with a reduced cost. However, it also has some shortcomings. The upper side and bottom side are tensioned and are spread directly by the stretch springs. Due to the single direction of spring tension, it is difficult for the grating plate to press close to the illumination filmstrip. As a result, the gap formed between the grating plate and the illumination filmstrip is locally too big, which generates false images causing imperfect picture effects from the illumination case. The step motors and the stretch springs are placed at the top and bottom side of the grating plate, which creates a larger length in the vertical direction.

Therefore, there is a need to improve upon the prior invention and create better picture effects while also shortening the size of the illumination case.

SUMMARY

The present invention satisfies these needs. The object of this invention is to overcome the above-mentioned shortcomings of the lamp case and provide an improved illumination case that can effectively eliminate false images of the illumination case's picture and reduce the size of the illumination case.

The object of this invention is realized through the measures described below. The improved illumination case includes a case-body, a front cover, an inner frame, a light source, a transparent back plate, an illumination filmstrip, a grating plate, and two step motors with a transmission that drives the grating plate to move up and down.

The transparent back plate is fixed onto the inner frame. The illumination filmstrip overlays the transparent back plate and is fixed against it. Two step motors, as mentioned above, are installed on the inner frame behind the upper part or lower part of the transparent back plate, one on the left side, and the other on the right side. The above-mentioned grating plate is fitted with a hanging bar on both the upper side and bottom side respectively, which make the grating plate spread out neatly. One hanging bar is linked with the transmissions of the two above-mentioned step motors through two corresponding levers. Through one lever, the other hanging bar connects with a set of stretch springs that is fitted onto the inner frame behind the transparent back plate. By this manner, the grating plate spreads out and presses close to the illumination filmstrip.

DESCRIPTION OF DRAWINGS

These and other features, aspects, and advantages of the present invention will become better understood with regard to the following description, appended claims, and accompanying drawings.

DETAILED DESCRIPTION OF THE INVENTION

Figure 2:
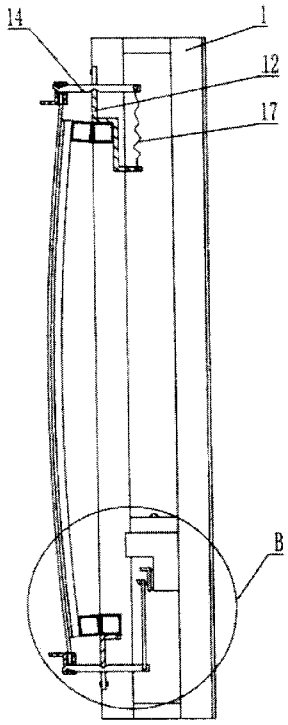
FIG. 2 is the A—A sectional view of FIG. 1.
Figure 1:
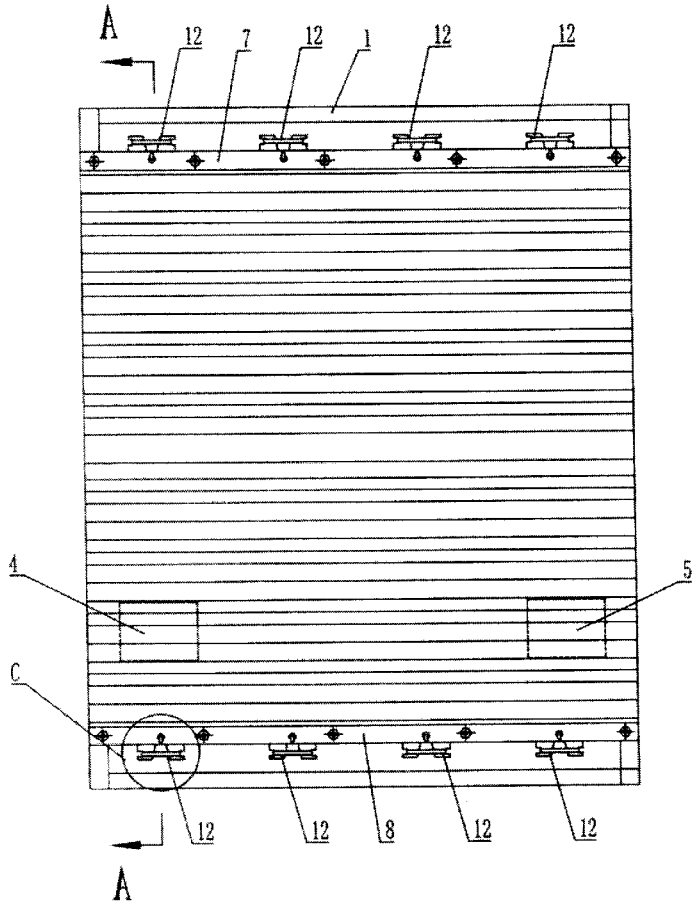
FIG. 1 is the schematic diagram of one embodiment of the grating plate structure installed on the inner frame of this invention.
Figure 4:
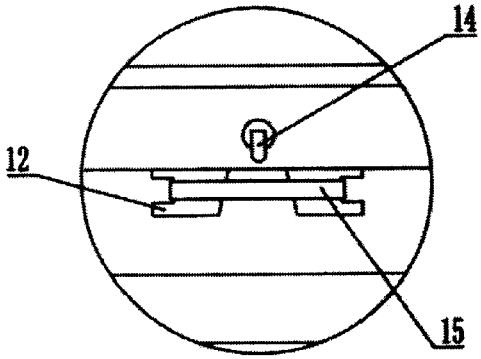
FIG. 4 is the enlarged view of the C-part of FIG. 1.
Figure 3:
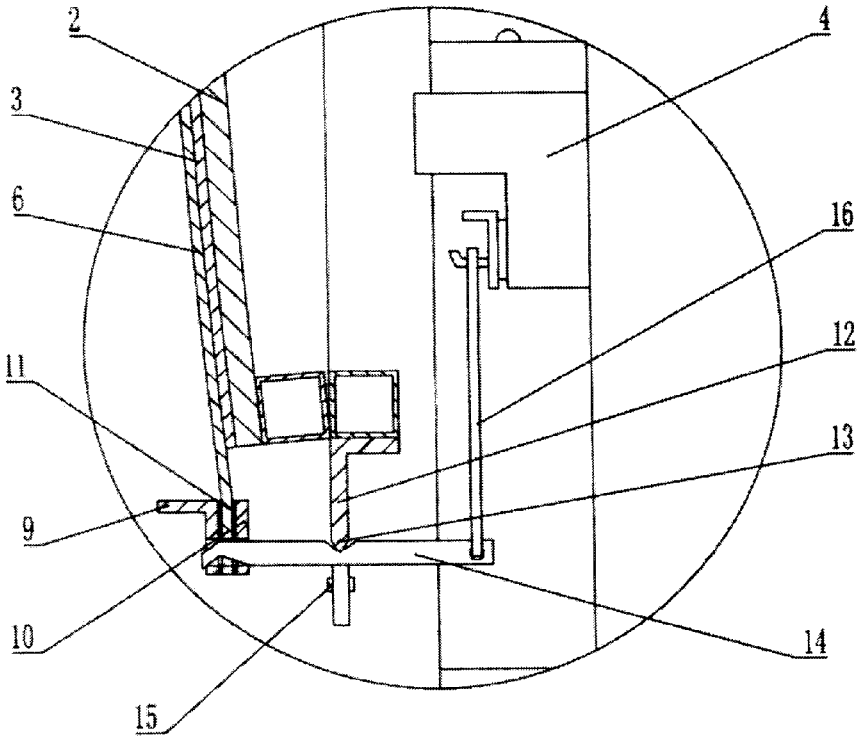
FIG. 3 is the enlarged view of the B-part of FIG. 2.

The illumination case includes a case-body, a front cover, a light source, and an inner frame (1). A transparent back plate (2) with a circular arc profile, made of organic glass, is fixed on the front of the inner frame (1). An illumination filmstrip (3) overlays the arc surface of the transparent back plate (2) and is fixed against it. Two step motors (4) (5) with transmissions are installed on the inner frame (1) behind the lower part of the transparent back plate (2), one on the left side, and the other on the right side. A grating plate (6) is fitted with hanging bars on both the upper side and bottom side.

The upper hanging bar (7) and the lower hanging bar (8) each consists of an angled aluminum piece (9), a flat aluminum bar (10) and forcing screws. When fitting, the angled aluminum piece (9) and the flat aluminum bar (10) are bonded to two sides of the grating plate (6) respectively, using a bonding agent (11). Further, the grating plate (6) is clamped tightly by the angled aluminum piece (9) and the flat aluminum bar (10) with forcing screws.

Each of a row of base levers (12), has a knife-edge shaped fulcrum (13) which is fixed on the inner frame (1) behind both the upper part and lower part of the transparent plate (2) respectively. There is a corresponding angular notch on a lever (14) to support the knife-edge shaped fulcrum (13). The front end of the lever (14) is hook-like, which hooks on to the link-eye on both the upper and lower hanging bar (7) and (8) of the grating plate, respectively. The base lever (12) is clamped into a locking piece (15) to prevent the angular notch of the lever (14) from coming off the knife-edge shaped fulcrum (13).

The transmission of the step motors (4) and (5) is fitted with a hook, which hooks on to a drag bar (16) that is pin-jointed with the back end of its corresponding lever (14). The back end of the lever (14), connected to the upper hanging bar (7) of the grating plate, is linked with a stretch spring (17) which is fitted onto the inner frame (1) behind the upper part of the transparent back plate (2).

In this manner, the grating plate (6) spreads out and is pressed tightly onto the illumination filmstrip (3). The grating plate (6) moves up and down, driven by two step motors (4) (5) that rotate forward or backward. For large illumination cases with long distances between the two step motors (4) and (5) which are placed on the left and the right respectively, the lower hanging bar (8) can be fitted with an auxiliary mechanism that is similar to the stretch mechanism of the lever-spring in the upper hanging bar (7). Such auxiliary mechanism will keep the grating plate (6) and the illumination filmstrip (3) pressed tightly.

Both the upper side and lower side of the grating plate, in accordance with the present invention, are fitted with hanging bars. A pulling force acts on the grating plate evenly throughout the hanging bars, which makes the grating plate press tightly onto the illumination filmstrip. By this way, false images can be eliminated and the effect and quality of the illumination case's pictures are improved. The drive devices and stretch springs are installed behind the grating plate, which greatly reduces the width between the top edge and bottom edge of the front cover of the illumination case and shortens the size of the illumination case.

What is claimed is:

1. An improved illumination case for use in a case body having a front cover and a light source, said illumination case uses a relative movement of a grating plate to an illumination filmstrip to cause an appearance that pictures on the illumination case are changing or moving, said illumination case comprising:

wherein a transmission for each step motor drives the grating plate to move;

wherein said transparent back plate is fixed onto the inner frame;

wherein said illumination filmstrip overlays the transparent back plate and is fixed against it;

wherein said step motors are installed on the inner frame behind an upper part or lower part of the transparent back plate, one on a left side, and the other on a right side;

wherein said grating plate has an upper side and a lower side which are each fitted with a hanging bar, causing the grating plate to spread out neatly;

wherein one hanging bar is linked with the transmission of each of the two step motors through a corresponding set of levers installed on the inner frame;

wherein the other hanging bar connects with a set of stretch springs that is fitted onto the inner frame behind the transparent back plate, causing the grating plate to spread out and press close onto the illumination filmstrip.

2. The improved illumination case of claim 1, wherein each lever has a corresponding lever base having a knife-edge shaped fulcrum which rests on an angular notch on each lever for support, wherein said lever base is clamped into a locking piece to keep the angular notch on the lever aligned with the knife-edge shaped fulcrum of the lever base.

* * * * *